US005535678A

United States Patent [19]

Brown

[11] Patent Number: 5,535,678

[45] **Date of Patent: *Jul. 16, 1996**

[54] LEAD-FREE FIREARM BULLETS AND CARTRIDGES INCLUDING SAME

[75] Inventor: John E. Brown, St. Catherines, Canada

[73] Assignees: Robert E. Petersen; Ken Elliot; Thomas Siatos, all of Los Angeles, Calif.; a part interest

[ * ] Notice: The term of this patend shall not extend beyond the expiration date of Pat. No. 4,949,644.

[21] Appl. No.: 430,690

[22] Filed: Apr. 27, 1995

Related U.S. Application Data

[63] Continuation of Ser. No. 115,793, Sep. 3, 1993, abandoned, which is a continuation of Ser. No. 859,251, Mar. 26, 1992, abandoned, which is a continuation of Ser. No. 606,257, Oct. 31, 1990, abandoned.

[51] Int. Cl.[6] ..... F42B 5/02; F42B 12/00

[52] U.S. Cl. ..... 102/439; 102/501; 102/514; 102/517

[58] Field of Search ..... 102/430, 439, 102/398, 501, 506–510, 514–518, 529; 420/577

[56] References Cited

U.S. PATENT DOCUMENTS

| | | | |
|---|---|---|---|
| 204,298 | 5/1878 | Crooke . | |
| 838,511 | 12/1906 | Saunders | 102/501 |
| 1,072,880 | 9/1913 | Tewes | 102/514 |
| 1,518,920 | 12/1924 | Halloran | 102/439 |
| 2,095,302 | 10/1937 | Woodford et al. | 420/577 |
| 2,966,427 | 12/1960 | Breining | 117/106 |
| 2,985,287 | 6/1961 | Auxier . | |
| 3,003,420 | 10/1961 | Nosler | 102/514 |
| 3,045,334 | 7/1962 | Berzins | 29/194 |
| 3,058,420 | 10/1962 | Tanner et al. | 102/439 |
| 3,065,535 | 11/1962 | Crehan et al. | 29/484 |
| 3,198,877 | 8/1965 | Olson et al. | 174/74 |
| 3,481,796 | 12/1969 | Brown | 148/1.6 |
| 3,880,081 | 4/1975 | Riffin et al. | 102/67 |
| 3,897,732 | 8/1975 | Atkins et al. | 102/92.3 |
| 4,005,660 | 2/1977 | Pichard | 102/92.1 |
| 4,167,904 | 9/1979 | Ferri | 102/452 |
| 4,236,922 | 12/1980 | Michl et al. | 75/134 |
| 4,381,692 | 5/1983 | Weintraub | 86/20 B |
| 4,383,853 | 5/1983 | Zapffe | 75/122.7 |
| 4,397,812 | 8/1983 | Mallory, Jr. | 420/441 |
| 4,428,295 | 1/1984 | Urs | 102/448 |
| 4,454,175 | 6/1984 | Martin | 427/242 |
| 4,655,832 | 4/1987 | Omori et al. | 106/1.18 |
| 4,686,904 | 8/1987 | Stafford | 102/439 |
| 4,714,023 | 12/1987 | Brown | 102/516 |
| 4,729,321 | 3/1988 | Stafford | 102/496 |
| 4,949,644 | 8/1990 | Brown | 102/498 |

FOREIGN PATENT DOCUMENTS

| | | | |
|---|---|---|---|
| 2609540 | 7/1988 | France . | |
| 27342 | of 1907 | United Kingdom | 102/514 |
| 278448 | 11/1927 | United Kingdom . | |
| 2121522 | 12/1983 | United Kingdom . | |

OTHER PUBLICATIONS

Webster's New Word Dictionary Third College Edition, Copyright 1988, p. 45.

Metals Handbook by Lyman, 8th Ed. vol. 1. Properties and Selection of Metals, American Society In Metals, 1961, pp. 893 and 864.

*Primary Examiner*—Harold J. Tudor

*Attorney, Agent, or Firm*—Rothwell, Figg, Ernst & Kurz

[57] ABSTRACT

A firearm bullet, at least a major portion of which is formed of a one-piece element having a continuous all-metal structure primarily made up of bismuth or a bismuth alloy.

21 Claims, 1 Drawing Sheet

LEAD-FREE FIREARM BULLETS AND CARTRIDGES INCLUDING SAME

This is a continuation of application Ser. No. 08/115,793, filed Sep. 3, 1993 now abandoned, which is a continuation of application Ser. No. 07/859,251, filed Mar. 26, 1992 now abandoned which is a continuation of application Ser. No. 07/606,257, filed Oct. 31, 1990 now abandoned.

BACKGROUND OF THE INVENTION

1. Field of the Invention

The present invention relates to improved bullets for firearms, and cartridges including same.

2. Description of the Background Art

Most bullets for firearms are formed totally or partially from lead. The density of lead provides bullets made therefrom with a ballistic efficiency which heretofore has not been matched by any other commercially available bullet material. While bullets jacketed with an outer layer of copper or other material are available to prevent barrel fouling and the like, such bullet cores typically are made of lead to provide the bullet with acceptable ballistic properties. Unfortunately, lead is quite toxic, which has raised environmental concerns.

Lead core bullets which are clad in copper or other material do not eliminate the toxicity problem, since the copper sheathing typically peels back when a fired bullet impacts an object, thereby exposing the lead core.

There remains a need in the art for completely lead-free bullets which perform ballistically similar to bullets made with lead.

SUMMARY OF THE INVENTION

In accordance with one aspect of the present invention, a projectile is provided which comprises a firearm bullet, at least a principal portion of which is formed of a one-piece element having a continuous all-metal structure primarily made up of bismuth.

In accordance with another aspect of the invention, a firearm cartridge is provided comprising a casing, a propellant contained within the casing, means for igniting the propellant, and a firearm bullet, at least a principal portion of which is formed of a one-piece element having a continuous all-metal structure containing bismuth.

DETAILED DESCRIPTION OF THE PREFERRED EMBODIMENTS

Figure 1:
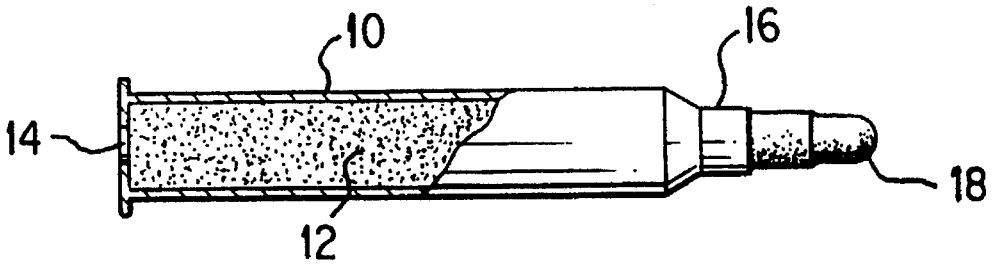
FIG. 1 is a partly schematic cross-sectional view of a firearm cartridge including a one-piece bullet containing bismuth according to one embodiment of the present invention.

FIG. 1 illustrates a firearm cartridge including a casing 10 which can, for example, be made up of brass. Within casing

10 is an explosive propellant in the form of powder 12. The propellant 12 is ignited by means of a primer 14 which is actuated when struck by the firing pin of a firearm (not shown).

Held within neck 16 of casing 10 is a bismuth-containing bullet 18 according to one embodiment of the present invention. Bullet 18 shown in FIG. 1 is made in one piece with an all-metal continuous structure formed by any suitable method such as casting.

Figure 2:
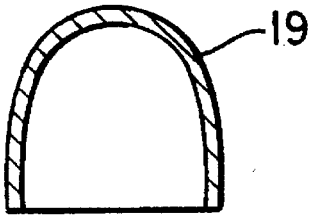
FIG. 2 is a partly schematic cross-sectional view of a one-piece, bismuth-containing shotgun slug according to another embodiment.

Applicant has discovered that bismuth is an excellent material for use in the manufacture of firearm bullets of any useful size. For example, the invention is applicable to bullets in the size range of from about 0.22 caliber up to 10 gauge slugs for shotguns. FIG. 2 shows a one-piece, bismuth-containing shotgun slug 19 according to one embodiment.

Figure 3:
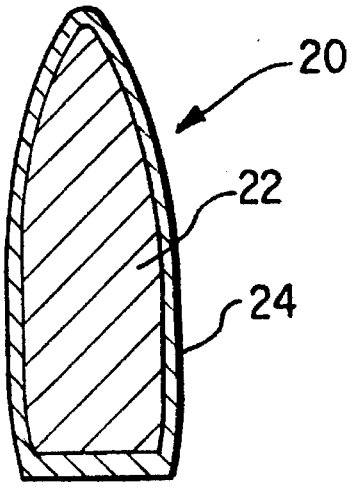
FIG. 3 is a partly schematic cross-sectional view of a two piece, bismuth-containing bullet according to still another embodiment.
Figure 4:
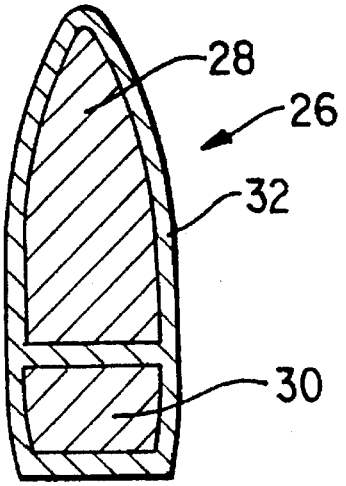
FIG. 4 is a partly schematic cross-sectional view of a three piece, bismuth-containing bullet according to yet another embodiment.

The present invention is also applicable to so-called "clad" or "jacketed" bullets, such as are illustrated in FIGS. 3 and 4. These jacketed bullets include one or more bismuth-containing elements, each of which is formed as a one-piece element having a continuous all-metal structure primarily made up of bismuth.

In FIG. 3, the bullet 20 is made up of a single, one-piece, bismuth-containing core element 32 surrounded by a metal jacket 24, which can be of any suitable metal such as copper or copper alloy.

In FIG. 4, the bullet 26 includes two bismuth-containing core elements 28 and 30 which are surrounded by metal jacket 32.

In preferred embodiments, the bismuth-containing elements of jacketed bullets such as are shown in FIGS. 2 and 3 comprise at least about 50% by weight of the entire bullet, more preferably, at least about 75% by weight thereof.

The bismuth-containing elements of bullets in accordance with the present invention are formed by casting, spin molding, dropping, punching or in any other suitable manner, and can be made from substantially pure bismuth. It has also been discovered that bismuth provides an excellent alloy component when combined with other non-toxic metals for forming non-toxic bullets. For example, in preferred embodiments, the bismuth-containing elements of bullets in accordance with the present invention contain at least about 50% bismuth by weight. In more preferred embodiments, the bismuth-containing elements contain at least about 60%, 70%, 80%, 90% or 95% by weight bismuth.

Bismuth-containing elements of bullets formed from alloy containing 60–95% by weight or more bismuth perform well ballistically, and with increasingly high proportions of bismuth, such bullets approach or attain the ballistic performance of corresponding lead bullets.

In particularly preferred embodiments, the bismuth-containing elements of bullets according to the invention contain about 98% by weight or more bismuth. For example, an alloy containing about 98% by weight bismuth and about 2% by weight tin or antimony can be used in bullets which perform ballistically substantially the same as lead.

In other particularly preferred embodiments, the bismuth-containing elements of bullets in accordance with the present invention contain about 99% by weight or more bismuth. For example, an alloy of about 99% by weight bismuth and about 1% by weight zinc has about the same density as lead and performs substantially the same ballistically as lead.

The present invention can provide bullets which perform ballistically substantially the same as corresponding bullets made with lead. Furthermore, bullets containing bismuth in accordance with the present invention have deformation characteristics similar to corresponding bullets made with lead. This provides bullets containing bismuth according to the invention with similar animal stopping characteristics as corresponding bullets made with lead, but without the poisonous effects of lead on the environment.

Since many modifications, variations and changes in detail may be made to the described embodiments, it is intended that all matter in the foregoing description and shown in the accompanying drawings be interpreted as illustrative and not in a limiting sense.

I claim:

1. A projectile comprising a non-toxic lead-free firearm bullet to be fired individually from a cartridge, said bullet being primarily made up of bismuth, said bullet being of a size in a range of from about 0.22 caliber to about 10 gauge, at least a principal portion of said bullet being a one-piece element having a continuous all-metal structure formed of bismuth alloy, said alloy being at least 70% by weight bismuth.

2. The projectile of claim 1, wherein said one-piece element contains at least about 80% by weight or more bismuth.

3. The projectile of claim 1, wherein said one-piece element contains at least about 90% by weight or more bismuth.

4. The projectile of claim 1, wherein said one-piece element contains at least about 95% by weight or more bismuth.

5. The projectile of claim 1, wherein said one-piece element contains at least about 98% by weight or more bismuth.

6. The projectile of claim 1, wherein said one-piece element contains at least about 99% by weight or more bismuth.

7. The projectile of claim 1, wherein said one-piece element comprises at least about 50% by weight of said bullet.

8. The projectile of claim 7, wherein said one-piece element is a bullet core, which bullet core is surrounded by a metal jacket.

9. The projectile of claim 8, wherein said bullet core comprises at least about 75% by weight of said bullet.

10. The projectile of claim 9, wherein said one-piece jacket contains copper.

11. The projectile of claim 8, further including a second one-piece element having a continuous all-metal structure primarily made up of bismuth alloy, the second one-piece element being a second bullet core which is surrounded by said metal jacket.

12. The projectile of claim 11, wherein the first and second one-piece elements comprise at least about 75% by weight of said bullet.

13. The projectile of claim 11, wherein said one-piece jacket contains copper.

14. The projectile of claim 1, wherein said bullet is made up substantially entirely of said one-piece element having a continuous structure.

15. A projectile comprising a non-toxic lead-free firearm bullet, at least a principal portion of said bullet being formed of a one-piece element having a continuous all-metal structure primarily made up of "Bismuth" alloy, said one-piece element (is) being formed by casting, spin molding, dropping or punching, said bullet being of a size in the range of from about 0.22 caliber to about 10 gauge, said one-piece element being at least 70% by weight bismuth.

16. A firearm cartridge comprising:

a) a casing;

b) a propellant contained within said casing;

c) means for igniting said propellant; and d) a single firearm bullet to be fired individually from the cartridge, said bullet being non-toxic, lead-free and primarily made up of bismuth, said bullet being of a size in a range of from about 0.22 caliber to about 10 gauge, at least a principal portion of said bullet being a one-piece element having a continuous all-metal structure formed of bismuth alloy, said alloy being at least 70% by weight bismuth.

17. The firearm cartridge of claim 16, wherein the bismuth-containing element comprises at least 75% by weight of said bullet.

18. A projectile comprising a non-toxic lead-free firearm bullet to be fired individually from a cartridge, said bullet being primarily made up of bismuth, said bullet being of a size in a range of from about 0.22 caliber to about 10 gauge, at least a principal portion of said bullet being a one-piece element having a continuous all-metal structure containing bismuth, said one-piece element being at least 70% by weight bismuth.

19. The projectile of claim 18, wherein said one-piece element comprises at least 75% by weight of said bullet.

20. A firearm cartridge comprising:

a) a casing;

b) a propellant contained within said casing;

c) means for igniting said propellant; and d) a single firearm bullet to be fired individually from the cartridge, said bullet being non-toxic, lead-free and primarily made up of bismuth, said bullet being of a size in a range of from about 0.22 caliber to about 10 gauge, at least a principal portion of said bullet being a one-piece element having a continuous all-metal structure containing bismuth, said one-piece element being at least 70% by weight bismuth.

21. The firearm cartridge of claim 20, wherein said one-piece element comprises at least 75% by weight of said bullet.

* * * * *

UNITED STATES PATENT AND TRADEMARK OFFICE

CERTIFICATE OF CORRECTION

PATENT NO. : 5,535,678

DATED : July 16, 1996

INVENTOR(S) : John E. Brown

It is certified that error appears in the above-indentified patent and that said Letters Patent is hereby corrected as shown below:

Col. 4, line 7 (claim 15), ""Bismuth"" should be -- bismuth --;
Col. 4, line 8 (claim 15), delete "(is)".

Signed and Sealed this

Eighteenth Day of February, 1997

*Attest:*

*Attesting Officer*

BRUCE LEHMAN

*Commissioner of Patents and Trademarks*